United States Patent [19]

Di Raffaele et al.

[11] Patent Number: 4,462,503

[45] Date of Patent: Jul. 31, 1984

[54] BEVERAGE CONTAINER WITH ENCLOSED STRAW

[76] Inventors: Rudolph Di Raffaele, c/o George Spector, 3615 Woolworth Bldg., 233 Broadway; George Spector, c/o Rudolph Di Raffaele, 3615 Woolworth Bldg., 233 Broadway, both of, New York, N.Y. 10007

[21] Appl. No.: 409,159

[22] Filed: Aug. 18, 1982

[51] Int. Cl.[3] ..... A47G 19/22

[52] U.S. Cl. ..... 220/90.2; 215/1 A; 229/7 S

[58] Field of Search ..... 220/90.2, 90.4, 90.6; 229/7 S; 215/1 A

[56] References Cited

U.S. PATENT DOCUMENTS

| | | | |
|---|---|---|---|
| 3,325,076 | 6/1967 | Soucy | 229/7 S |
| 3,656,654 | 4/1972 | Brinkley | 220/90.2 |
| 4,036,392 | 7/1977 | Martin | 229/7 S |
| 4,226,356 | 10/1980 | Lemelson | 220/90.2 |
| 4,247,016 | 1/1981 | Shaw | 229/7 S |

*Primary Examiner*—George E. Lowrance

[57] ABSTRACT

A container with pull up straw is provided and consists of a beverage can, a pull tab hingably affixed to the top of the beverage can, a straw having two flexible sections in the upper portion of the straw and a clamp affixed to the underside of the pull tab and between the two flexible sections in the upper portion of the straw whereby the upper portion of the straw bends around the top of the beverage can so that when the pull tab is pulled the upper portion of the straw will come out of the beverage can. A retainer is also provided for holding the lower portion of the straw in a fixed position within the beverage can. Alternatively a spring stiffener may be affixed to the end of the clamp so that the upper portion of the straw will come out of the beverage can straight and the pull tab can be resealable to the top of the beverage can.

2 Claims, 4 Drawing Figures

BEVERAGE CONTAINER WITH ENCLOSED STRAW

BACKGROUND OF THE INVENTION

The instant invention relates generally to beverage containers and more specifically it relates to a container with pull-up straw.

It is a known fact that when a person purchases a can of beverage and wants to drink it, they must look or ask for a straw. When the can is opened the lid will emerge into the liquid. If there isn't a straw then the person must place his mouth in contact with the open portion on the top of the can. This is not sanitary so accordingly this situation is in need of an improvement.

SUMMARY OF THE INVENTION

A principle object of the present invention is to provide a container with pull-up straw that is connected to the underside of the pull tab so that when said pull tab is pulled the upper portion of the straw will come out of a beverage can.

Another object is to provide a container with pull-up straw that is built into the beverage can to keep the straw sanitized.

An additional object is to provide a container with pull-up straw that has a resealable pull tab so that beverage within said beverage can will be stored and used again.

A further object is to provide a container with pull-up straw that is economical in cost to manufacture.

A still further object is to provide a container with pull-up straw that is simple and easy to use.

Further objects of the invention will appear as the description proceeds.

To the accomplishment of the above and related objects, this invention may be embodied the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENT

Figure 1:
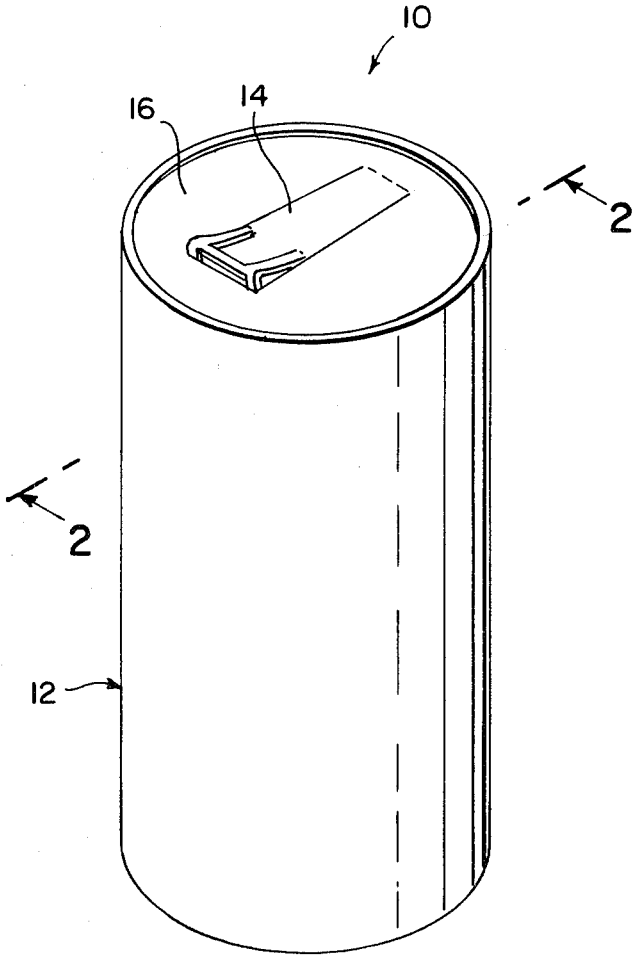
FIG. 1 is an isometric view of the invention.
Figure 2:
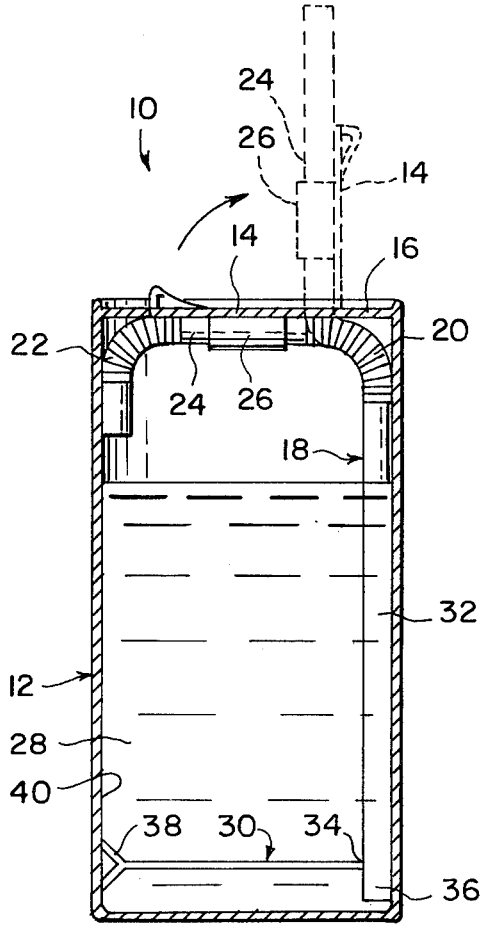
FIG. 2 is a cross-sectional view taken along line 2—2 in FIG. 1.

Turning now descriptively to the drawings, in which similar reference characters denote similar elements throughout the several views, FIGS. 1 and 2, illustrates a container with pull-up straw 10. The container 10 consists of a beverage can 12 having a pull tab 14 hingably affixed to the top 16 of the beverage can 12. A straw 18 is provided having two flexible sections 20 and 22 in the upper portion 24 of the straw 18. A clamp 26 is affixed to the underside of the pull tab 14 and between the two flexible sections 2 and 22 in the upper portion 24 of the straw 18. The upper portion 24 of the straw 18 bends around the top 16 of the beverage can 12 so that when the pull tab 14 is pulled the upper portion 24 of the straw 18 will come out of the beverage can 12 as shown in dotted in FIG. 2. The beverage 28 in FIG. 2 is shown below the upper portion 24 of the straw 18.

The container 10 further contains a retainer 30 for holding the lower portion 32 of the straw 18 in a fixed position within the beverage can 12. The retainer 30 has one end 34 affixed perpendicular to the free end 36 of the lower portion 32 of the straw 18. The other forked end 38 engages the wall 40 of the beverage can 12 so that the lower portion 32 of the straw 18 will not move.

Figure 3:
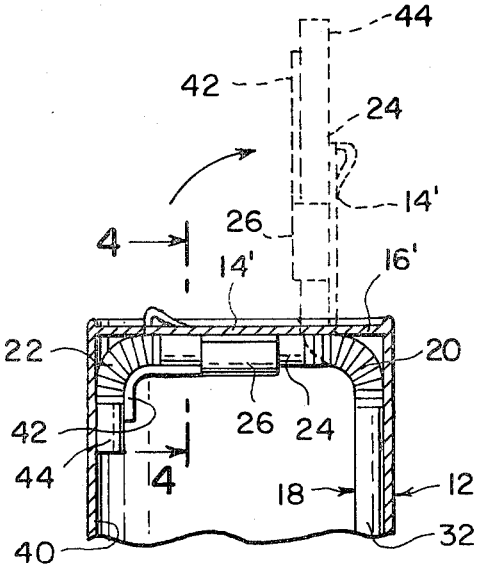
FIG. 3 is a partial cross-sectional view similar to FIG. 2 of another embodiment of the invention.

FIG. 3 shows another embodiment of the invention. A spring stiffener 42 is affixed to the end of the clamp 26 so that when the pull tab 14' is pulled the upper portion 24 of the straw 18 will come out of the beverage can 12 causing the spring stiffener 42 to press against the free end 44 of the upper portion 24 of the straw 18 until the free end 44 of the upper portion 24 of the straw 18 is straight as shown in dotted in FIG. 3.

Figure 4:
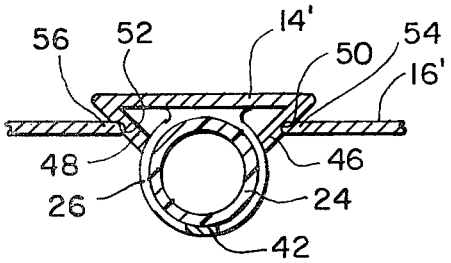
FIG. 4 is a cross-sectional view taken along line 4—4 in FIG. 3.

FIG. 4 shows in greater detail a resealable pull tab 14'. The pull tab 14' contains two downwardly and diagonally side portions 46 and 48 having notches 50 and 52 that snap-in and engage with ends 54 and 56 of top 16' of the beverage can 12. The resealable pull tab 14' can be closed so that the beverage 28 within the beverage can 12 can be stored and used again if a person does not want to drink all of the beverage 28 at one time.

The ciamp 26 and spring stiffener 42 can be made of any suitable material but preferably metal. The straw 18 and retainer 30 can be made of any suitable material but preferably plastic. The can top and pull tap are all made out of metal.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container with pull-up straw which comprises:

(a) a beverage can;

(b) a pull tab hingably affixed to top of said beverage can;

(c) a straw having two flexible sections in upper portion of said straw; and (d) a clamp affixed to underside of said pull tab and between said two flexible sections in said upper portion of said straw whereby said upper portion of said straw bends around said top of said beverage can so that when said pull tab is pulled said upper portion of said straw will come out of said beverage can, further comprising a means for holding a lower portion of said straw in a fixed position within said beverage can wherein said means for holding lower portion of said straw in a fixed position within said beverage can is a retainer having one end affixed perpendicular to a free end of said lower portion of said straw and an other forked end engaging the wall of said beverage can so that said lower portion of said straw will not move, providing a spring stiffener affixed to end of said clamp sc that when said pull tab is pulled said upper portion of said straw will come out of said beverage can causing said spring stiffener to press against free end of said upper portion of said straw until said free end of said upper portion of said straw is straight.

2. A container with pull-up straw as recited in claim 1 wherein said pull tab is resealable to said top of said beverage can so that beverage within said beverage can, can be stored and used again.

* * * * *